United States Patent [19]

Häcker

[11] Patent Number: 4,644,762

[45] Date of Patent: Feb. 24, 1987

[54] MULTIPLE SYSTEM CIRCULAR KNITTING MACHINE FOR KNITTING STOCKINGS

[75] Inventor: Wolfgang Häcker, Altenstadt, Fed. Rep. of Germany

[73] Assignee: Fred Vatter Strumpffabriken Schongau-Altenstadt GmbH, Schongau, Fed. Rep. of Germany

[21] Appl. No.: 761,541

[22] Filed: Aug. 1, 1985

Related U.S. Application Data

[63] Continuation of Ser. No. 548,088, Nov. 2, 1983, abandoned, which is a continuation-in-part of Ser. No. 251,137, Apr. 6, 1981, abandoned.

[30] Foreign Application Priority Data

Jun. 12, 1980 [DE] Fed. Rep. of Germany ..... 3022080
Jul. 28, 1980 [DE] Fed. Rep. of Germany ..... 3028603
Jan. 28, 1981 [DE] Fed. Rep. of Germany ..... 3102814

[51] Int. Cl.[4] ..... D04B 9/20
[52] U.S. Cl. ..... 66/51
[58] Field of Search ..... 66/46, 48, 51, 52, 53

[56] References Cited

U.S. PATENT DOCUMENTS 2,313,642 3/1943 Holmes et al. ..... 66/48 X
2,902,845 9/1959 McDonough ..... 66/48
3,650,126 3/1972 Luchi ..... 66/48
4,188,804 2/1980 Hoffmann ..... 66/51 X

FOREIGN PATENT DOCUMENTS 2484475 12/1981 France ..... 66/51
1590895 6/1981 United Kingdom ..... 66/51

*Primary Examiner*—Wm. Carter Reynolds
*Attorney, Agent, or Firm*—James E. Nilles; Thomas F. Kirby

[57] ABSTRACT

A multiple system circular knitting machine for knitting stockings, having a reciprocating device for knitting the heel cup using at least two feeds. The needles are advanced solely by jacks in the reciprocating mode, in the rotation mode they are controlled solely by needle advancing cams. A high knitting speed in the rotation mode as well as in the reciprocating mode is achieved by providing that the advancing cams used for advancing the needles in the rotation mode are deactivated in the reciprocating mode.

3 Claims, 6 Drawing Figures

Figure 1:
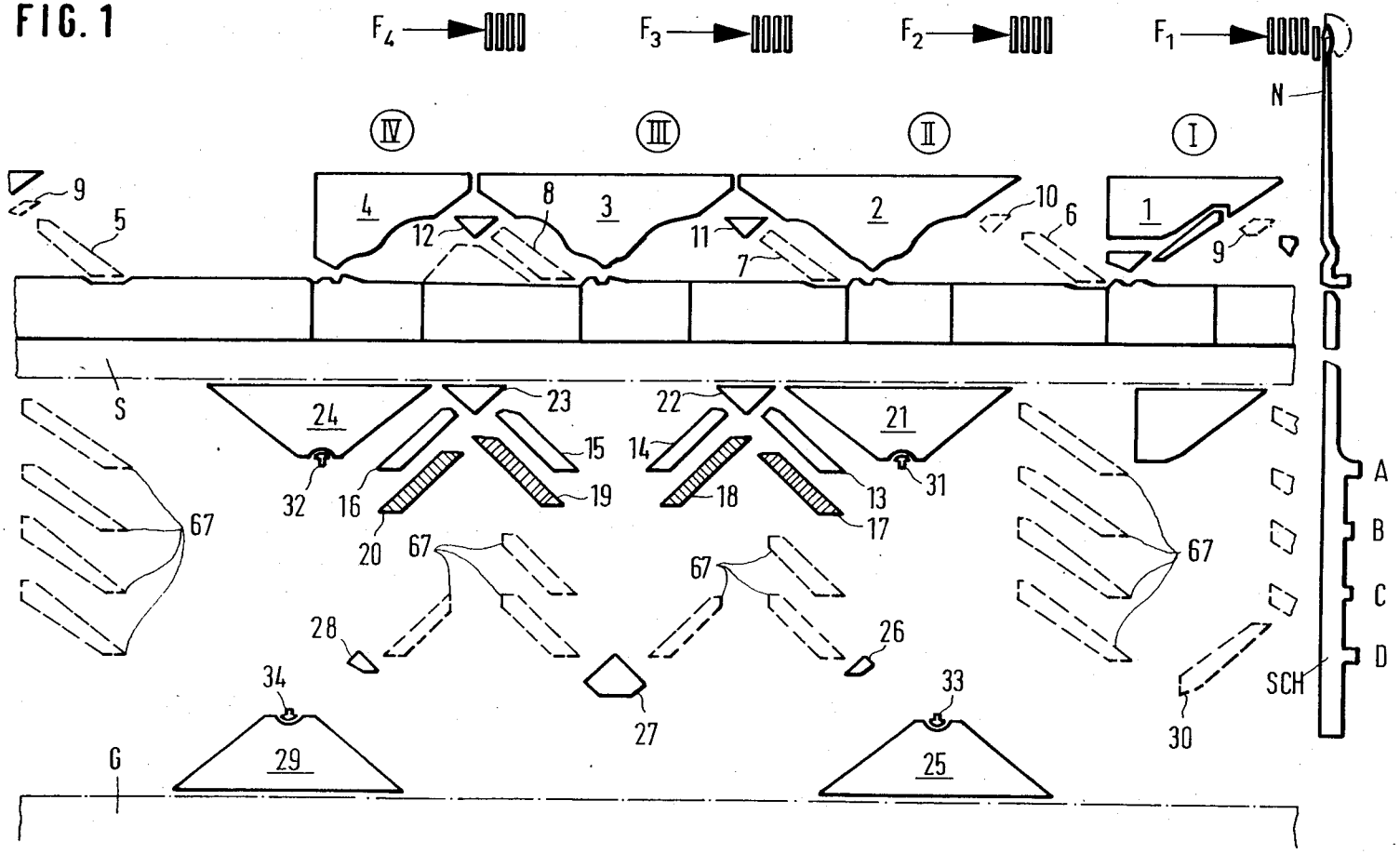

FIG. 3
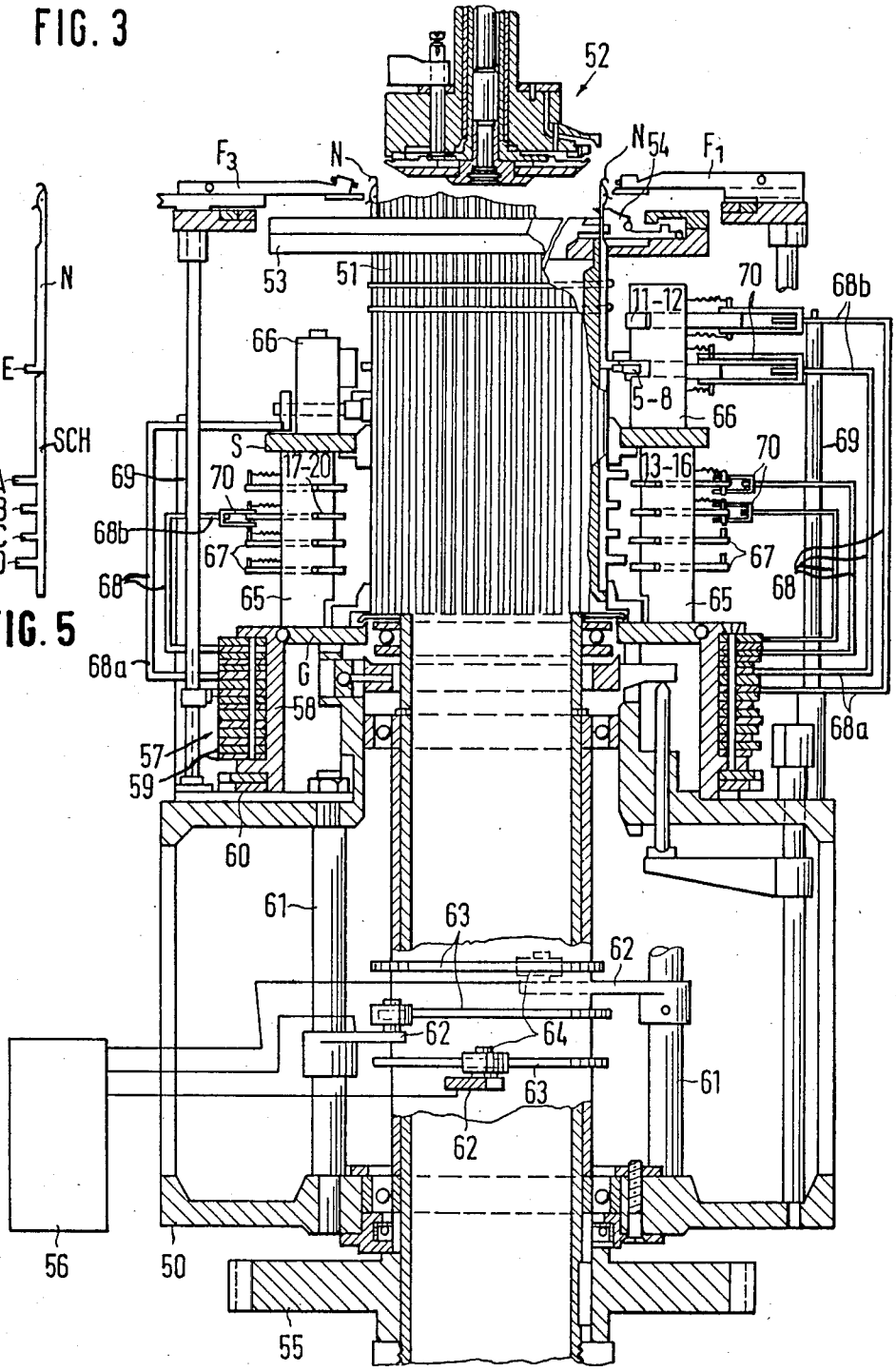
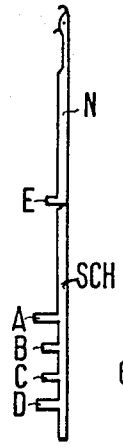
FIG. 5

MULTIPLE SYSTEM CIRCULAR KNITTING MACHINE FOR KNITTING STOCKINGS

This is a continuation of U.S. patent application Ser. No. 548,088, filed Nov. 2, 1983, now abandoned, which in turn was a continuation-in-part of U.S. patent application Ser. No. 251,137, filed Apr. 6, 1981, now abandoned.

BACKGROUND OF THE INVENTION

This invention relates to a multiple system circular knitting machine for knitting stockings, said machine having a needle cylinder which can be driven either in a rotational or in a reciprocatory mode.

In a known machine of this type as described in DE-OS No. 28 25 864, the needles are always, i.e. not only in the reciprocating mode, but also in the rotation mode of the machine, advanced by means of jacks. Although this known machine is adapted to operate with three feeds in the reciprocating mode, so that the heel cup can be knit at high speeds, the machine has a rather low overall output, since the maximum obtainable speed in the rotation mode is limited by the necessity to move the jacks as well as the needles.

It has further been known for a long time to knit the heel portion on a four-feed circular knitting machine in the reciprocating mode employing only one feed. This method suffers from the disadvantage that the knitting speed of the machine is rather low in the reciprocating mode, so that the heel portion accounts for nearly a third of the overall time for the knitting of a stocking.

It is an object of the present invention to provide a multiple feed circular knitting machine of the type set forth in the introduction, which is capable of high operating speeds in the rotation mode as well as in the reciprocating mode.

This object is attained by a multiple system circular knitting machine for knitting stockings having leg portions and heel cup portions, said machine being operable in a rotation mode to knit said leg portions and being operable in a reciprocating mode to knit said heel cup portions, said machine comprising: needles, needle retractors (1–4), jacks (SCH) and jack advancing and retracting cams (13–30) together with narrowing (31–32) and widening (33–34) pickers, needle advancing cams (5–8) for advancing the needles in the rotation mode, and a reciprocating means for knitting the heel cup using at least two of said multiple systems; wherein during said reciprocating mode all needles are adapted to be retracted out of the knitting position by said needle retractors (1–4) and to be advanced only by means of said jacks (SCH), said needle advancing cams (5–8) being adapted to be deactivated in said reciprocating mode; so that said needles are lifted to their thread take-up position during said reciprocating mode solely by said jacks.

In the circular knitting machine according to the invention, the needle control in the rotation mode is carried out by needle cams without any contribution of the jacks, except for the case of pattern formation. In the rotation mode it is thus possible to achieve the maximum operating speed of which a circular knitting machine the needles of which are exclusively controlled by needle cams is capable. Since in the reciprocatory mode the needle advancing cams are deactivated, and the needles are solely raised by the jacks, it is possible, as in DE-OS No. 28 25 864, to knit the heel portion using two feeds without the danger of yarn breaks, so that a high operating speed is achieved also during formation of the heel portion. There is thus obtained a circular knitting machine including a reciprocatory operation mode for the production of stockings with a hitherto unobtained output rate.

In knitting of stocking heel portions in the reciprocating mode it is generally known that the needles have initially to be raised so far that the previously knit stitch slides over the tongue onto the needle shaft. Subsequently each needle is immediately pulled downwards into the tuck position, so that the freely exposed yarn adjacent the outermost needle cannot be caught under the tongue during knitting, which would otherwise result in dropped stitches and yarn breaks in the narrowing row. The downward movement of the needles to the tuck position is controlled by reversing cams.

In the known circular knitting machines having reciprocatory mode capability, the reversing cams are rigidly mounted in the cam support. In the rotation mode of the machine, the reversing cams accordingly also lower the previously advanced needles to the tuck position prior to their being fully withdrawn by the knitting cams. This results in difficulties at high rotational speeds, since the impingement of the needles on the reversing cams results in the occurrence of extremely high accelerations in the axial direction, which may lead to yarn breaks and needle damage.

It is therefore an additional object of the invention to improve a circular knitting machine in which reversing cams contribute to the needle control in the reciprocating mode in such a manner as to permit high rotational speeds in the rotation mode.

This additional object is attained by the knitting machine as described above and further including the feature that the reversing cam members (10, 11, 12) are adapted to be deactivated in said rotation mode.

In the rotation mode the reversing cams are thus deactivated, so that the needles are moved downwards solely by the knitting cams. This permits rotational speeds of up to about 800 rpm to be readily attained. A high production capacity is thus obtained in the rotation mode, with a similar capacity being maintained in the reciprocating mode due to the use of two systems.

Figure 2:
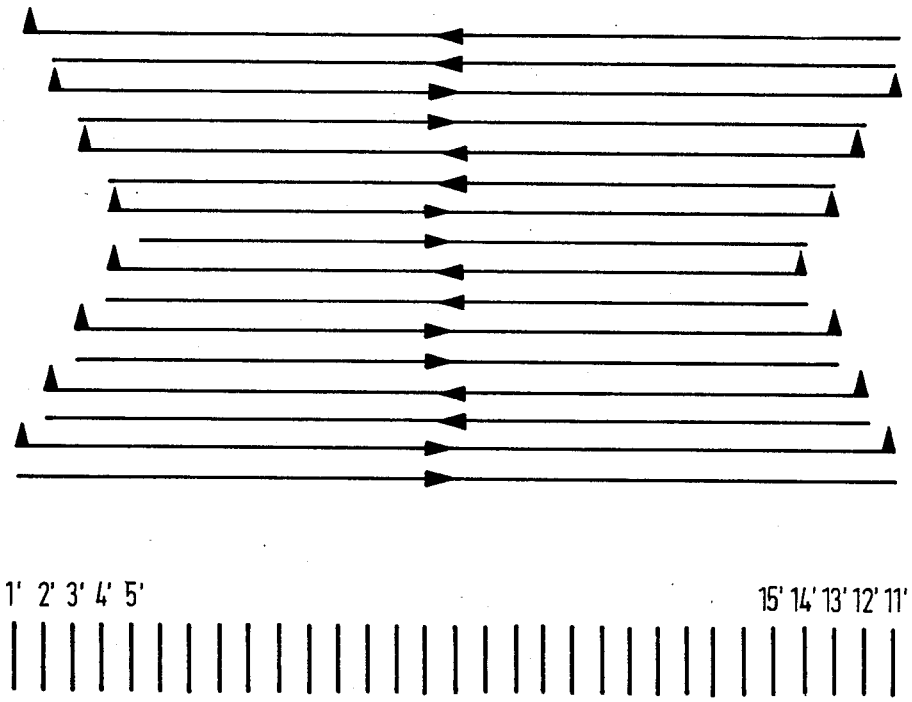
Figures 4, 6:
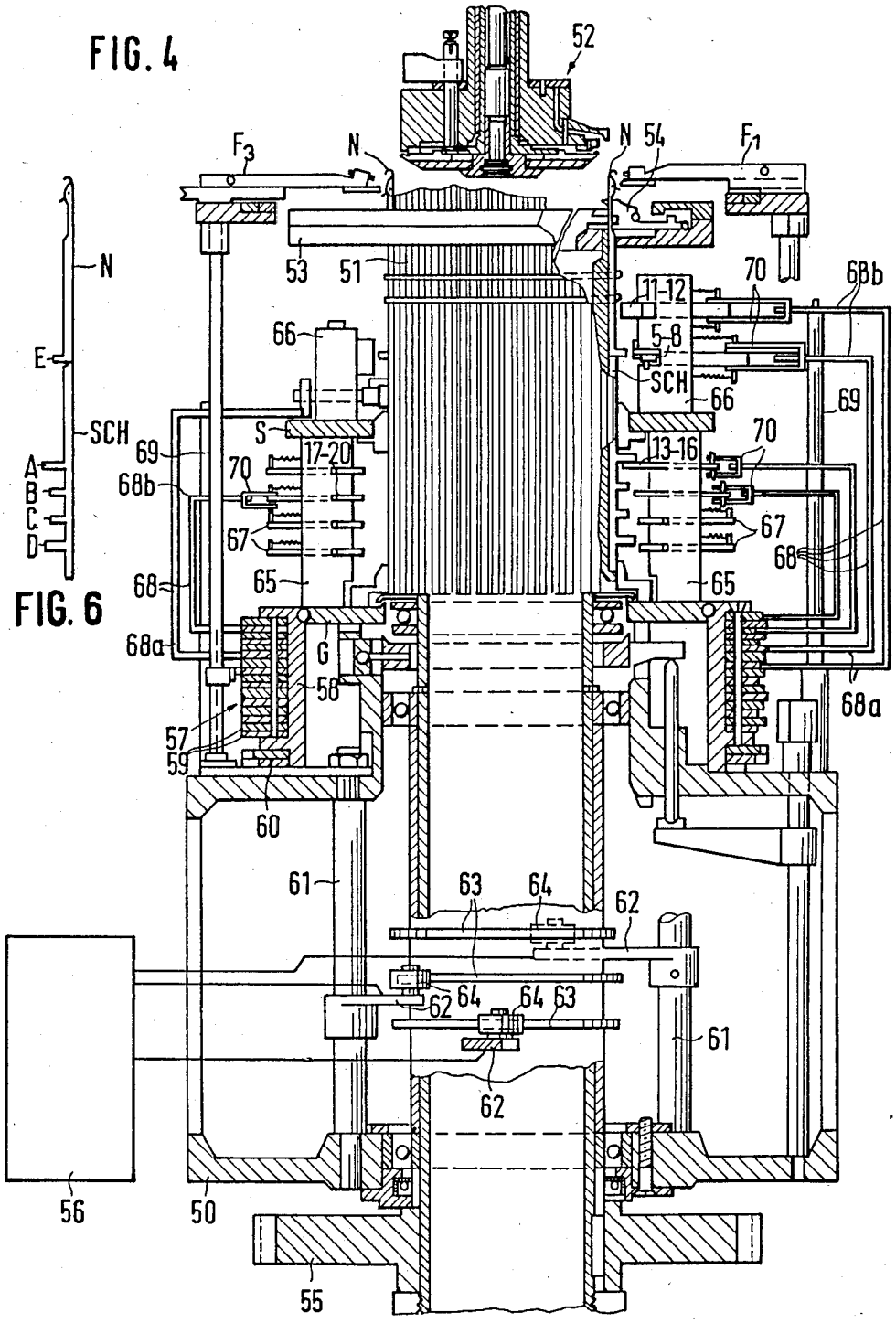

A preferred embodiment of the invention shall now be described with reference to the accompanying drawings, wherein:

FIG. 1 shows a diagrammatic developed view of the arrangement of cam and control members in a circular knitting machine for carrying out the method according to the invention, FIG. 2 shows a diagrammatic illustration of the stitch rows at the heel portion of a stocking made according to the invention, FIG. 3 is a vertical section through the upper portion of a circular knitting machine adapted to carry out the method according to the invention, said machine being shown in its rotating work mode, FIG. 4 shows the same machine as FIG. 3 in its reciprocating working mode, and FIGS. 5 and 6 each show a representative needle and its associated jack.

The knitting machine shown in FIGS. 3 and 4 has a stationary frame 50 in which a grooved needle cylinder 51 is rotatably supported. Needles N and jacks SCH are slidingly arranged in the grooves of the needle cylinder 51. One needle N and one jack SCH are shown separately in FIGS. 5 and 6. Each needle has a butt E. Each jack has longer butts A and D and shorter butts B and C.

A dial plate arrangement 52 is provided above and concentrically with the needle cylinder 51. The upper edge of the needle cylinder 51 is surrounded by a grooved sinker ring 53 guiding sinkers 54.

Attached to the lower end of the needle cylinder 51 is a gearwheel 55. The gearwheel 55 cooperates with a gear arrangement of a conventional drive which causes the needle cylinder to either rotate continuously or to perform a reciprocatory movement over approximately 360°.

A patterning apparatus 56 of conventional mechanical or electrical type is provided. This patterning apparatus acts on a cam ring drum 57 surrounding the middle portion of the needle cylinder 51. The cam ring drum 57 consists of a drum hub 58 and a pile of cam rings 59. The cam ring drum 57 is rotatably supported on the housing 50. A ratchet wheel 60 is fixedly mounted on the lower end of the drum hub 58 and cooperates with a plurality, e.g. three, ratchets (not shown). These ratchets are driven by shafts 61 on which levers 62 are mounted. Eccentric switching cams 63 on the needle cylinder 51 act on the shafts 61 via cam followers 64. The patterning apparatus 56 controls the radial position of the cam followers 64. When the cam followers are in their radially inward position, they are active in transmitting a switching movement from the respective switching cam 63 to the levers 62 and thence to the shaft 61 and its associated ratchet, which in turn rotates the ratchet wheel 60 by one tooth. In their radially outward position the cam followers 64 are inactive.

Rigidly mounted on base plate 6 and cam plate 5 are jack cam supports 65 and needle cam supports 66 respectively. Said plates are part of the machine frame 50. Jack cams and needle cams are mounted in their respective supports so as to be movable radially of the needle cylinder. Jack cams 13–16, 17–20 and 67 are visible in FIGS. 3 and 4, with further such cams being provided above, below and at the same level as said visible jack cams at other locations around the needle cylinder. Needle cams 5–8 and 11–12 are visible in FIGS. 3 and 4 with further such cams being arranged at the same levels as said visible jacks at other locations around the needle cylinder.

U-shaped rocking arms 68 are mounted for pivotal movement about vertical shafts 69, lower horizontal legs 68*a* of said rocking arms contacting respective cam rings 59, while upper horizontal legs 68*b* of said rocking arms are connected with the jack respective needle cams by means of spring-loaded brackets 70.

It will be clear that by rotating the cam ring drum 57 the rocking arms 68 can be pivoted about their shafts 69 which pivotal movement in turn changes the radial position of the jack respective needle cams. Three different radial positions can be asumed by the jack cams in the shown embodiment of the machine, whereas two different radial positions can be attained by the needle cams. This is caused by the cam rings 59 controlling the jack cams having three different radial heights and the cam rings 59 controlling the needle cams having two different heights as shown on the right side of FIGS. 3 and 4.

Yarn feeds $F_{1-4}$ are arranged at angular intervals around the periphery of the upper edge of the needle cylinder 51, with feeds $F_1$ and $F_3$ being visible in FIGS. 3 and 4.

Shown schematically in FIG. 1 are four systems I to IV of the circular hosiery knitting machine according to FIGS. 3 and 4 with associated yarn guides F1 to F4. Shown at 1–10 are the needle cams associated with the individual systems, including needle advancing cams 5 to 8 together with controllable reversing cams 11 and 12. The needle cams control the movements of the needles N, one of which is shown at the right side of FIG. 1.

Shown below the cam plate S are the jack cams 13 to 30 and 67. One of the jacks is shown at SCH on the right side of FIG. 1.

FIG. 1 shows the various cams in the position which they assume when the machine works in its reciprocatory mode upon narrowing. The cams shown in broken lines are withdrawn to their radially outermost inactive position in which they do not contact any butts. The hatched cams are in their radially intermediate position in which they contact only the long butts A, D of the jacks SCH. The cams shown in full lines are in their radially innermost position in which they act on all the butts.

Located outside the knitting sector effective in the reciprocatory mode are narrowing pickers 31, 32, and widening pickers 33 and 34.

Generally the knitting machine described operates as follows:

At the beginning the needle cylinder is rotatably driven and all of the needle cams, with the exception of the reversing cams 11, 12 are in their inner, active positions. All of the jack cams are in their inactive, radially outermost positions. Yarn is fed through all of the yarn feeders $F_{1-4}$. Confer positions of cams in FIG. 3, where cams 11, 12 and all of the jack cams are withdrawn. The needles are controlled only by needle cams and the machine can work at high speed. After a welt, a stocking leg portion and possibly a slip portion have been knitted in the rotation mode with the needles being controlled in their upward and downward movements by the needle cams 1 to 10 in a conventional manner not to be described in detail, the machine is switched over from the rotation mode to the reciprocatory mode at the beginning of the heel portion. In the rotation mode, reversing cams 11 and 12 had been deactivated so as not to participate in the control of the needles N. The reversing cams 11 and 12 are now actuated to their operating positions, while needle advancing cam members 5 to 8 are deactivated by withdrawing them radially. The needle retractor cams 1 to 4 retract all needles N downwards to a rest position. Yarn continues to be fed only to two of the systems II III and IV, i.e. to the systems III and IV. System I and II are deactivated in the reciprocating mode, the jack cams 67 and 30 associated with said system being radially withdrawn to their inactive positions.

Control of the upward movement of the needles to the knitting position is now taken over by the jacks SCH controlled by jack cams 13 to 16 engaging jack butts A and jack cams 26 and 28 acting on butts D. Retraction of the needles is controlled by the double-faced needle retractor cams 2–4 and the two reversing cams 11 and 12.

During the counterclockwise reciprocatory stroke, the jack butts A are raised by cam 13, pushed downward by the upper jack reversing cam 22 and slide downward along the inner surface of jack cam 14. Lower jack reversing cam 27 subsequently engages jack butt D to raise the jack, whereupon the above sequence is repeated under the control of cams 15, 23, 16, 28.

Further during the counterclockwise reciprocatory stroke, the needles previously raised to the knitting position by cooperation of jacks SCH with jack cam 13 are lowered to the tuck position by jack reversing cam 11 and are subsequently retracted fully downward by needle retractor cam 3. Thereafter the needles are again raised to the knitting position by cooperation of the jacks with jack cam 15, lowered to the tuck position by reversing cam 12 and retracted fully downward by needle retractor cam 4.

During the counterclockwise knitting, yarn is fed to the systems III and IV through the yarn feeds F3 and F4, respectively.

During the clockwise reciprocatory stroke (from left to right in the drawing), the jack butts are raised by cam 16, pushed downward by the upper jack reversing cam 23 and slide downward along the inner surface of jack cam 15. Lower jack reversing cam 27 subsequently engages jack butt D to raise the jack, whereupon the above sequence is repeated under the control of cams 14, 22, 13, 26.

Further, during the clockwise reciprocatory stroke, the needles previously raised to the knitting position by cooperation of the jacks SCH with the jack cam 16 are lowered to the tuck position by jack reversing cam 12 and are subsequently retracted fully downward by needle retractor cam 3. Thereafter, the needles are again raised to the knitting position by cooperation of the jack with jack cam 14, lowered to the tuck position by reversing cam 11 and retracted fully downward by needle retractor cam 2.

For widening and narrowing, one needle is moved to the knitting position, or rest position, respectively, prior to the beginning of knitting, and a further needle after knitting the second of the two stitch rows knitting during each reciprocatory stroke.

In order to obtain an elastic narrowing or widening seam, respectively, in combination with small openings, a tuck stitch is formed on each narrowed or widened needle, respectively. The thus resulting stitch row pattern is shown in FIG. 2, wherein the reciprocating direction is indicated by centrally disposed arrows. The upstanding triangles at the ends of the stitch rows represent one tuck stitch each. The needles are shown below the stitch row pattern and designated by indexed numerals. From the shortening or lengthening, respectively, of the stitch rows it is to be recognized which of the needles shown therebelow have been narrowed, or widened respectively, and on which needles tuck stitches have been formed.

In detail, the operation proceeds as follows:

1. Narrowing in the counterclockwise direction:

Jack butt A1 (butt A of the jack associated with needle 1' in the diagram of FIG. 2) impinges on narrowing picker 31 and is pushed downward. Jack butt D1 moves under jack reversing cam 26, and jack butt A1 is raised to the tuck position by jack cam 17, and is subsequently lowered to the non-knitting position together with its jack and needle 1' by jack retractor cam 18. Reversing cam 27 acting on butt D1 completes this movement. Needle 1' welts at system IV to form a float of the yarn fed thereat. There is no engagement of cam 20 by butt A1 after the latter has passed below cam 19. The jack to be narrowed is fully withdrawn to its lowest position after its butt A1 has cleared cam 18 by action of the reversing cam 27 on butt D1. All of the remaining jack butts A and D along the heel-forming sector are controlled by jack cams 13, 22, 14, 27, 15, 23, 16 and 28 in the manner described hereinbefore. As the jack butts D are raised by jack reversing cam 28, jack butt A2 impinges on narrowing picker 32 and is pushed downward, so that jack butt D2 during the reverse stroke will move underneath jack reversing cam 28 to be subsequently raised to the tuck position by jack cam 20, and retracted to the non-knitting position by jack retracting cam 19. Thus the associated jack and its needle 2' are brought down to their non-knitting positions.

2. Narrowing in the clockwise direction:

Jack butt A11 impinges on narrowing picker 32 and is pushed downward. Jack butt D11 moves under jack reversing cam 28, so that jack butt A11 is raised to the tuck position by jack cam 20 and subsequently is moved to the non-knitting position together with its jack and needle 11' by jack retractor cam 19. This jack butt D11 then is engaged and lowered further by cam 27. All of the remaining jack butts A and D along the heel-forming sector are controlled by jack cams 16, 23, 15, 27, 14, 22, 13 and 26 in the manner described above. As jack butts D are raised by jack reversing cam 26, jack butt A12 impinges on narrowing picker 31 and is pushed downward, so that, for narrowing in the counterclockwise direction, jack butt D12 later, during the return stroke moves underneath reversing cam 26, whereupon its jack and the corresponding needle 12' is raised to the tuck position by jack cam 17 and then moved to the non-knitting position by retractor cam 18.

The jacks moved to the non-knitting position are no longer operative to raise the needles associated therewith. Since these needles have previously been pushed downward to their non-knitting positions by the needle retractor cams, they do no longer participate in the knitting operation.

3. Widening in the counterclockwise direction:

The jack cams 18 and 19 shown in their intermediate (hatched) position in FIG. 1 are now withdrawn radially to their inoperative outermost (broken-line) position.

Jack butt D12 impinges on widening picker 33, whereby it is raised to pass underneath jack reversing cam 26. Jack butt A12 is raised to the tuck position by jack cam 17. Jack retractor cam 18 is deactivated, so that jack butt A12 impinges on jack cam 14, so that the jack is moved downwardly. Jack butt D12 is lifted by jack reversal cam 27, so that jack butt A12 is moved upwardly into knitting position for the corresponding needle 12' by jack cam 15. Then the jack butt A12 is lowered by jack reversal cam 23 and is further moved downwardly by jack cam 16. Jack butt D12 impinges on lower jack reversal cam 28 which lifts the jack to a position in which it is lifted by cam 16 upon the return stroke.

All of the remaining jack butts A and D along the heel-forming sector are controlled by cam members 13, 22, 14, 27, 15, 23, 16 and 28 in the manner described above. As jack butts D are raised by jack reversing cam 28, jack butt D11 which had been lowered to the inactive level passes below reversing cam 28 and impinges on widening picker 34, whereby it is raised but only far enough to still pass underneath reversing cam 28, upon the return stroke in the clockwise direction. Jack butt A11 on the return clockwise stroke is raised to the tuck position by jack cam 20. Jack retractor cam 19 is deactivated, so that jack butt A11 impinges on jack cam 15 and is lowered. Jack butt D11 is raised by lower jack reversal cam 27. Jack butt A11 is raised by cam 14 and moves its associated needle 11' into knitting position. Then jack butt A11 is lowered by upper jack reversing cam 22, impinges on cam 13 and is further lowered. Jack butt D11 contacts lower jack reversing cam 26 and is lifted to a position in which jack butt A11 impinges on cam 13 on the return stroke.

4. Widening in the clockwise direction:

Jack butt D2 impinges on widening picker 34, whereby it is raised to pass underneath jack reversing cam 28. Jack butt A2 is raised to the tuck position by jack cam 20. Retractor cam member 19 is deactivated, so that in the following movement jack butt A2 contacts cam 15 and is lowered. Jack butt D2 contacts lower jack reversing cam 27 and is lifted. Jack butt A2 is raised by jack cam 14, moving its associated needle 2' back into knitting position. Then jack butt A2 is lowered by upper jack reversing cam 22 and contacts cam 13 to be further lowered. Jack butt D2 contacts lower jack reversing cam 26 and is again raised to a position in which jack butt A2 upon the reverse stroke is raised by cam 13.

All of the remaining jack butts A and D along the heel-forming sector are controlled by jack cam members 16, 23, 15, 27, 14, 22, 13 and 26 in the manner described above. As jack butts D are raised by jack reversing cam 26, jack butt D1 which had been lowered to its inactive position passes below reversing cam 26 and impinges on widening picker 33, whereby it is raised to pass upon the reverse stroke underneath reversing cam 26. Jack butt A1 is raised to the tuck position by jack cam 17 on the following counterclockwise stroke. Retractor cam member 18 is deactivated, so that in the following knitting stroke jack A1 returns to the knitting position together with the associated needle as described.

Due to the provision of two double-acting narrowing and widening pickers 31–34 each at the entrance and the exit of the reciprocating section of the cam arrangement, the jack butts are caused to impinge on the respective pickers while in the rest position. This reduces any tendency of rebound and erratic operation to occur, and permits the reciprocatory mode operation to be carried out safely and at high speeds.

I claim:

1. A multiple system circular knitting machine for knitting stockings having leg portions and heel cup portions, said machine being operable in a rotation mode to knit said leg portions and being operable in a reciprocating mode to knit said heel cup portions, said machine comprising: needles having butts thereon, needle retractors (1–4), jacks (SCH) and jack advancing and retracting cams (13–30) together with narrowing (31–32) and widening (33–34) pickers, needle advancing cams (5–8) engaging said butts for advancing the needles in the rotation mode, and a reciprocating means for knitting the heel cup using at least two of said multiple systems; wherein during said reciprocating mode all needles are adapted to be retracted out of the knitting position by said needle retractors (2–4) and to be advanced only by means of said jacks (SCH), means (57, 68*a–b*) being provided for said needle advancing cams (5–8) to be deactivated in said reciprocating mode; so that said needles are lifted to their thread take-up position during said reciprocating mode solely by said jacks.

2. A multiple system circular knitting machine according to claim 1, including reversing cam members contributing to the needle control in said reciprocating mode, characterized in that said reversing cam members (11, 12) are adapted to be deactivated in said rotation mode.

3. A circular knitting machine according to claim 1 or 2, characterized in that additional advancing cam members (26 to 28) for said jacks are provided acting on the jacks after stitch formation in the reciprocating mode.

* * * * *